US005327757A

United States Patent [19]

Wirth

[11] Patent Number: 5,327,757

[45] Date of Patent: Jul. 12, 1994

[54] STRAIGHTENING JAWS FOR A STRAIGHTENING DEVICE FOR STRAIGHTENING WIRE

[75] Inventor: Stephan Wirth, Reitnau, Switzerland

[73] Assignee: Pantex Stahl AG, Switzerland

[21] Appl. No.: 979,522

[22] Filed: Nov. 23, 1992

[30] Foreign Application Priority Data

Nov. 29, 1991 [CH] Switzerland ..... 3507/91-8

[51] Int. Cl.[5] ..... B21D 3/00; B21F 1/02

[52] U.S. Cl. ..... 72/79; 140/139

[58] Field of Search ..... 72/79; 140/139, 140

[56] References Cited

U.S. PATENT DOCUMENTS

| | | | |
|---|---|---|---|
| 1,473,256 | 11/1923 | Shuster | 72/79 |
| 3,335,764 | 8/1967 | Pilling . | |
| 4,177,843 | 12/1979 | Sarver . | |
| 4,920,776 | 5/1990 | Denzler | 72/79 |

FOREIGN PATENT DOCUMENTS

| | | | |
|---|---|---|---|
| 349328 | 3/1922 | Fed. Rep. of Germany . | |
| 0691174 | 5/1940 | Fed. Rep. of Germany | 72/79 |
| 1427325 | 12/1968 | Fed. Rep. of Germany . | |
| 2449873 | 4/1976 | Fed. Rep. of Germany . | |
| 0155490 | 6/1982 | Fed. Rep. of Germany | 72/79 |

*Primary Examiner*—David Jones

*Attorney, Agent, or Firm*—Willian Brinks Hofer Gilson & Lione

[57] ABSTRACT

The straightening jaw comprises a cubical chuck with a plane face end. The face end has an intake element and an exit element of a straightening groove. Between them is an opening arranged perpendicular to the face end. A straightening insert made of hard metal is inserted into the opening loosely but insured against twisting. On the face end, the straightening insert has a of saddle-shaped straightening indentation that connects the intake and exit elements. Because of this structure, long service lives of the straightening jaw and shorter down times of the straightening device causing low production costs are achieved.

20 Claims, 3 Drawing Sheets

STRAIGHTENING JAWS FOR A STRAIGHTENING DEVICE FOR STRAIGHTENING WIRE

Applicant claims, under 35 U.S.C. §119, the benefit of priority of the filing date of Nov. 29, 1991, of a Swiss application, copy attached, Serial No. 3507/91-8, filed on the aforementioned date, the entire contents of which are incorporated herein by reference.

BACKGROUND OF THE INVENTION

Known straightening devices for straightening wire have as working parts a plurality of replaceable straightening jaws across which the wire is drawn. Depending on the type of wire to be drawn, the straightening jaws consist of different materials. For straightening wires made of reinforcing steel, for example, straightening jaws made of gray cast iron are used. The jaws wear out relatively quickly, however, particularly if the wire to be straightened has a profile that protrudes outward. This results in a short service life for the straightening jaws.

OBJECT AND SUMMARY OF THE INVENTION

The object of the present invention is to develop straightening jaws of the type described at the outset, so that they facilitate cost-effective operation of a straightening device. Straightening jaws for a straightening device for straightening wire comprise a chuck comprising a first end and a second end, wherein said first end comprises a straightening groove having an intake element and an exit element and a cylindrical opening between the intake element and the exit element that runs perpendicular to the first end and a straightening insert inserted into said opening, wherein said straightening insert has an end with a saddle-shaped straightening indentation that connects said intake element with said exit element.

Exemplary embodiments of the invention are explained by means of the following drawings.

DESCRIPTION OF THE PREFERRED EMBODIMENTS

Figure 1:
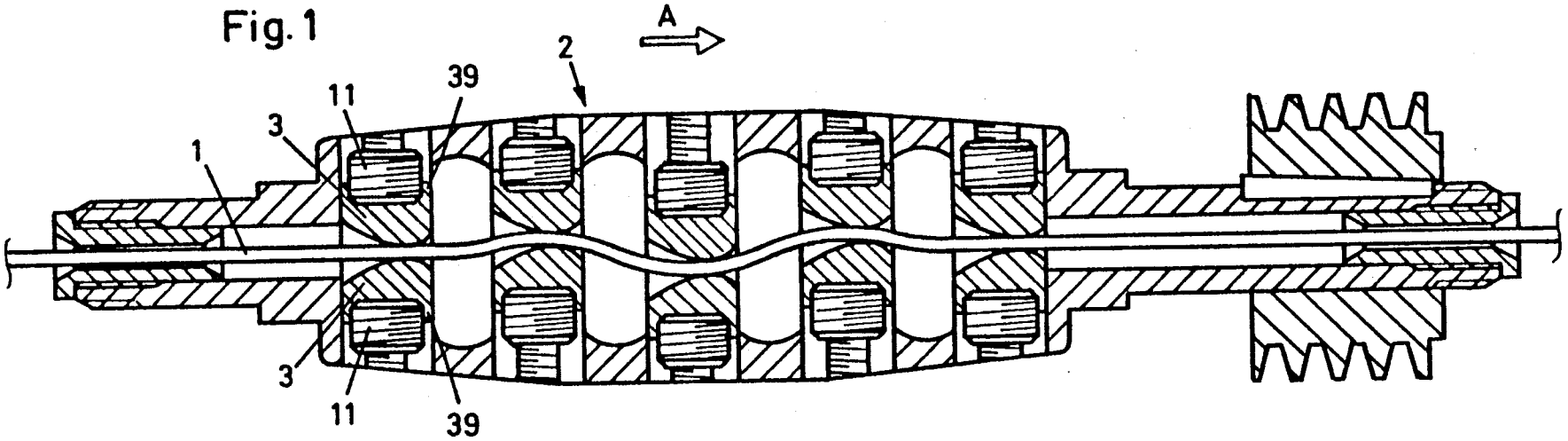
FIG. 1 is a cross-sectional view of an embodiment of the present invention having a longitudinal section through a straightening body with five pairs of straightening jaws.
Figure 2:
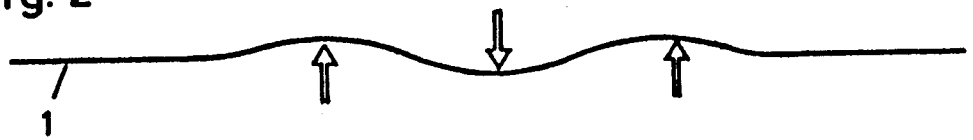
FIG. 2 shows the change in shape of the wire during straightening by the embodiment of FIG. 1.

FIGS. 1 and 2 show a straightening system for the straightening of a wire 1 in a rotating straightening body 2. Five pairs of straightening jaws 3 define a straightening channel in which wire 1 passes through and is bent in an undulating manner in accordance with FIG. 3, where the undulations change continuously as they rotate, due to the rotation of the straightening body. This rotation releases the tension in the wire, and the wire leaves the straightening device in a straight shape, and is subsequently cut into lengths.

Figure 3:
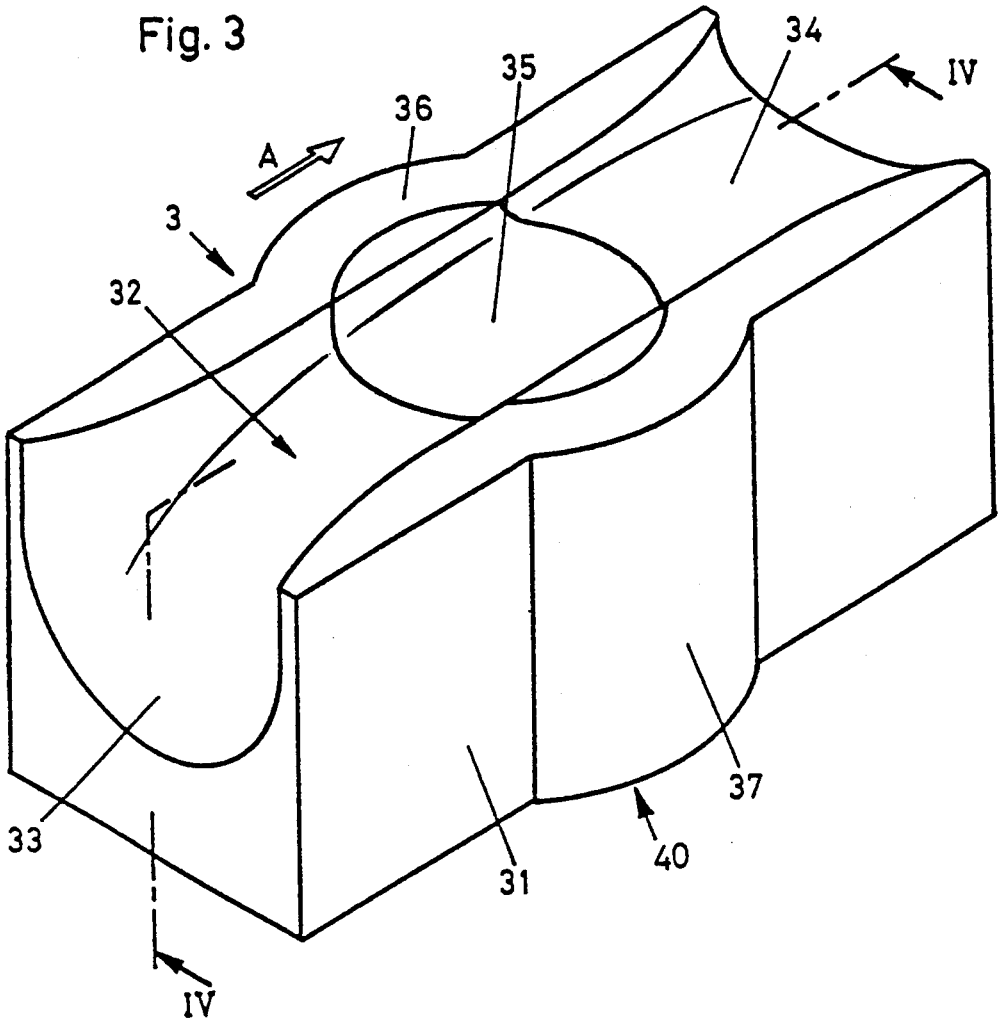
FIG. 3 is a perspective view of an embodiment of a straightening jaw used in accordance with the present invention.
Figure 4:
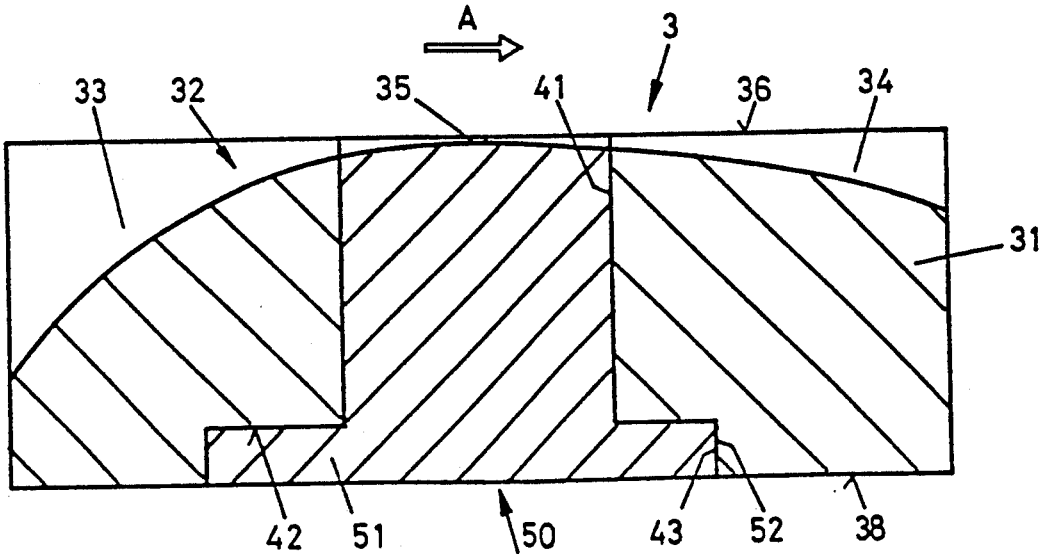
FIG. 4 is a longitudinal sectional view taken along line IV—IV of the embodiment of the present invention shown in FIG. 3.

A straightening jaw 3 in accordance with the invention is represented in FIGS. 3 and 4. A nearly cubical chuck 31 is provided on a first face end 36 with a longitudinal straightening groove 32 which is symmetric with respect to a central plane of the straightening jaw. On the face end 36 of the chuck 31, an intake element 33 and an exit element 34 are formed by the groove 32. The intake element and exit element are preferably identical, symmetrical to a center plane of the straightening jaw, which is not in keeping with the representation in FIG. 4. The bottom of both the intake element 33 and the exit element 34 inclines toward the face end 36. They converge against one another. In the middle, the chuck 31 has a thickened portion 37 on both sides, shaped like a cylinder segment that curves outwardly and is similar to a cylinder 40 that penetrates the chuck 31 and whose axis runs perpendicular to the face end 36. In another embodiment the cylindrical opening may be replaced by a prismatic opening. This cylinder 40 has a central bore 41 whose axis is likewise perpendicular to the upper face end 36 and into which a cylindrical straightening insert form 50 is inserted. Central bore 41 forms a cylindrical opening between the intake element and the exit element that runs perpendicular to the first end. Likewise, a prismatic opening that runs perpendicular to the first end would be formed between the intake and exit element in the case of the straightening insert 50 being in the shape of a prism or prismatic form. The straightening insert 50 has a saddle-shaped straightening indentation 35 on the upper face end that connects the intake element 33 and the exit element 34 to each other and with them forms the groove 32. The lower end of the bore 41 opens into a concentric countersunk bore 42 that has a stop face 43 located at one or more positions. The straightening insert 50 is cylindrical. On the end opposite the straightening indentation 35, the straightening insert 50 has a concentric flange 51 whose stop faces 52 correspond to the stop faces 43 of the countersunk bore 42. In this way the straightening insert 50 remains aligned in the bore 41.

As shown in FIG. 1, the chuck screws 11 in the straightening body 2 determine the position of the pairs of straightening jaw 3 and thereby press against the side of the chuck 31, in which the countersunk bore 42 and the flange 51 are found. Hence the straightening insert 50 does not have to be soldered in place. The insert can be easily replaced if a wire with a different diameter must be machined or a worn-out straightening insert has to be replaced. The chuck 31 can therefore be used repeatedly. The straightening jaw 3 may have a plane area 38 lying opposite the upper face end 36 or may be provided with projections 39 as shown in the embodiment of FIG. 1. These projections 39 protect the screws 11 if the wire 1 breaks.

The material of the straightening insert 50 depends on the intended purpose. For wires made of reinforcing steels with or without a profile, the material of the straightening insert 50 preferably comprises a hard metal. The material of chuck 31, on the other hand, preferably comprises gray cast iron. Both the chuck 31 and the straightening insert 50 can be produced at low cost. Because of the easy replaceability, the down time for the straightening device is kept low.

In another embodiment, it would be possible to solder the straightening insert 50 into the bore 41. The applicant has, however, determined that, surprisingly, the service lives are significantly longer when the straightening insert 50 is only placed loosely into the chuck 31. This condition is ascribed to the fact that hard soldering of the hard metal has a detrimental influence on the properties of the material. An additional increase in the service life by approximately 30% to approximately 50% can be achieved by periodically turning the straightening jaws 3. It is therefore preferable to embody the straightening groove 32 symmetrically relative to the center plane of the straightening jaws 3. Periodically turning the straightening jaws 3 has a positive effect on the strain on the straightening device.

Figure 5:
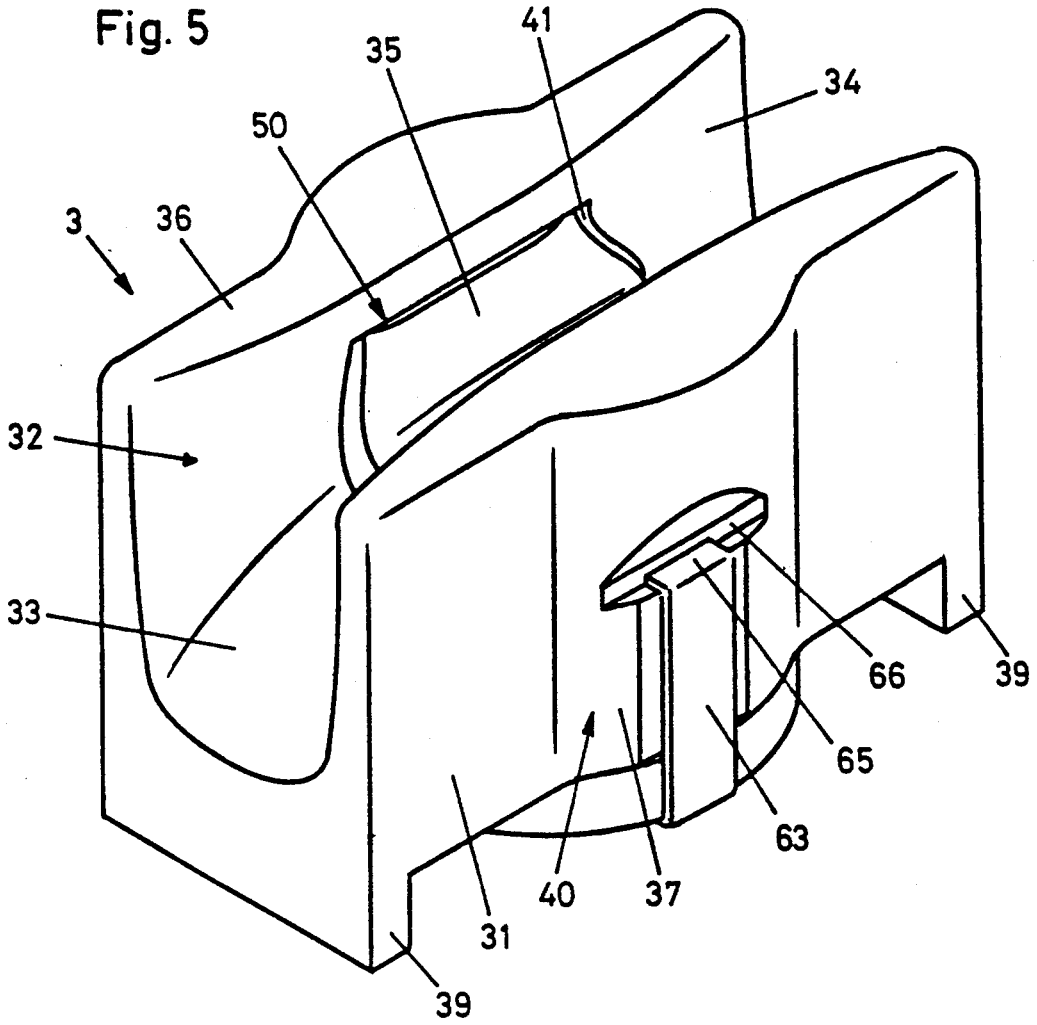
FIG. 5 is a perspective view of a second embodiment of a straightening jaw according to the present invention.
Figure 6:
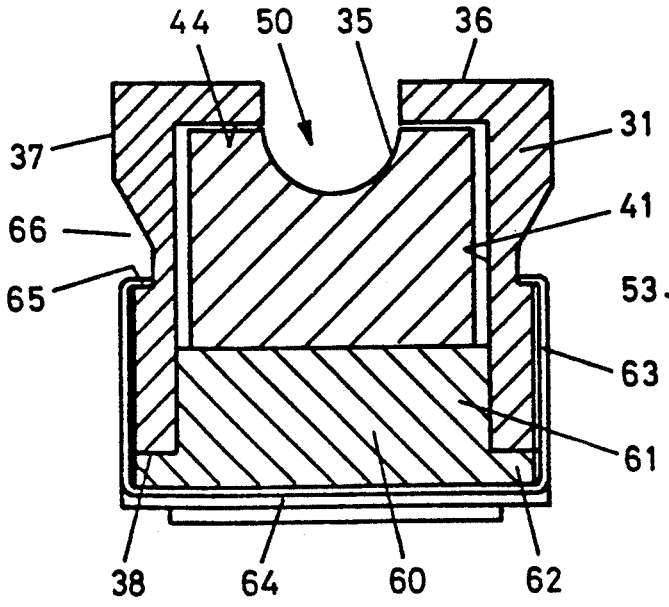
FIG. 6 is a cross-sectional view of the second embodiment of the straightening jaw in accordance with FIG. 5.
Figure 7:
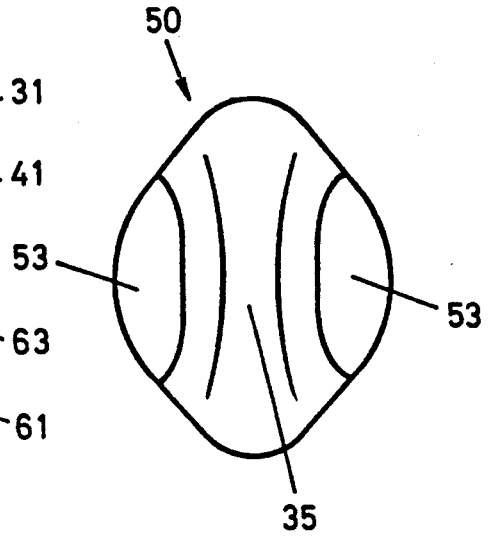
FIG. 7 is a front view of a straightening insert.

A second exemplary embodiment in accordance with FIGS. 5–7 is provided with the same reference numerals for analogous elements, so that a detailed explanation of these elements is unnecessary. The embodiment in accordance with FIGS. 5–7 is distinguished from those in FIGS. 3 and 4 mainly in that the flange 51 of the straightening insert 50 is omitted. The straightening insert 50 is cylindrical or prismatic over its entire height. As shown in FIG. 7, straightening insert 50 has a non-circular nearly constant oval-shaped cross-section to prevent relative rotation. The opening 41 also has a correspondingly non-circular oval-shaped cross-section. The straightening insert 50 can have ample play of up to several millimeters.

In order to prevent the straightening insert 50 from falling out when the jaw 3 is installed in the straightening body 2, the opening 41 has a shoulder 44 on top adjoining the face end for restraining the straightening insert. Shoulder 44 is positioned laterally of the straightening groove 32, against which level end faces 53 of the straightening insert 50 rest. So that the straightening jaw 3 can be installed and removed as a unit, the bottom of the opening 41 is at least partially sealed with a holding element, such as a lid 60 that is centered with a circular cylindrical peg 61, for example, inserted in the opening 41 and that rests with a flange 62 on the lower opposite face end 38 of the chuck 31. The lid 60 is held or locked onto the chuck 31 by a locking device such as stay 63 made of spring steel or catch springs so as to prevent relative motion with respect to the chuck 31. This stay can be placed in a groove 64 of the lid 60 and latches on top with hooks 65 in grooves 66 in the thickened portions 37 of the chuck 31. Thus, straightening insert 50 is held positively on all sides in chuck 31 having ample play.

Because of this structure the straightening insert 50 can be manufactured especially inexpensively. Once again, the chuck 31 can also be re-used multiple times.

It is intended that the foregoing detailed description be regarded as illustrative rather than limiting, and that it be understood that it is the following claims, including all equivalents, which are intended to define the scope of the invention.

I claim:

1. Straightening jaws for a straightening device for straightening wire, comprising:

a chuck comprising a first end and a second end, wherein said first end comprises a straightening groove having an intake element and an exit element and a cylindrical opening between the intake element and the exit element that runs perpendicular to the first end; and a straightening insert inserted into said opening and said straightening insert is held positively on all sides in said chuck with play, wherein said straightening insert has an end with a saddle-shaped straightening indentation that connects said intake element with said exit element.

2. The straightening jaws in accordance with claim 1, wherein said opening has a shoulder adjoining said first end for restraining said straightening insert, and a holding element which at least partially seals the opening is inserted into the opposite second face end.

3. The straightening jaws in accordance with claim 2, wherein said holding element is locked onto said chuck with catch springs.

4. The straightening jaws in accordance with claim 1, wherein said opening and said straightening insert each have a non-circular cross-section

5. The straightening jaws in accordance with claim 2, wherein said opening and said straightening insert each have a non-circular cross-section.

6. The straightening jaws in accordance with claim 2, wherein said straightening indentation insert is made of a material comprising a hard metal.

7. The straightening jaws in accordance with claim 1, wherein said chuck is made of a material comprising gray cast iron.

8. The straightening jaws in accordance with claim 1, wherein said straightening groove is symmetrical with respect to a central plane of said straightening jaw.

9. A straightening insert for use in a straightening jaw comprising:

a cylindrical form having a first end;

a saddle-shaped straightening indentation on said first end; and a locking device for preventing relative rotation with respect to a chuck, wherein said straightening inset has a non-circular, nearly constant cross-section.

10. The straightening insert in accordance with claim 9, wherein said straightening indentation insert is made of a material comprising a hard metal.

11. Straightening jaws for a straightening device for straightening wire, comprising:

a chuck comprising a first end and a second end, wherein said first end comprises a straightening groove having an intake element and an exit element and a prismatic opening between the intake element and the exit element that runs perpendicular to the first end; and a straightening insert inserted into said opening, wherein said straightening insert has an end with a saddle-shaped straightening indentation that connects said intake element with said exit element, wherein said straightening insert is held positively on all sides in said chuck with play.

12. The straightening jaws in accordance with claim 11, wherein said opening has a shoulder adjoining said first end for restraining said straightening insert, and a holding element which at least partially seals the opening is inserted into the opposite second face end.

13. The straightening jaws in accordance with claim 12, wherein said holding element is locked onto said chuck with catch springs.

14. The straightening jaws in accordance with claim 12, wherein said straightening groove is symmetrical with respect to a central plane of said straightening jaw.

15. The straightening jaws in accordance with claim 11, wherein said chuck is made of a material comprising gray cast iron.

16. The straightening jaws in accordance with claim 11, wherein said straightening groove is symmetrical with respect to a central plane of said straightening jaw.

17. A straightening insert for use in a straightening jaw comprising:

a prismatic form having a first end;

a saddle-shaped straightening indentation on said first end; and a locking device for preventing relative rotation with respect to a chuck.

18. The straightening insert in accordance with claim 17, wherein said straightening indentation is made of a material comprising a hard metal.

19. A straightening device for straightening a wire, comprising:

a straightening body having a straightening channel wherein said wire is inserted therein and wherein said channel is defined by a straightening jaw;

said straightening jaw comprises a chuck, wherein said chuck comprises a first end and a second end, wherein said firs tend comprises a straightening groove having an intake element and an exit element and a prismatic opening between the intake element and the exit element that runs perpendicular to the first end; and a straightening insert inserted into said opening so that said straightening insert is held in said chuck with play, wherein said straightening insert has an end with a saddle-shaped straightening indentation that connects said intake element with said exit element.

20. A straightening device for straightening a wire, comprising:

a straightening body having a straightening channel wherein said wire is inserted therein and wherein said channel is defined by a straightening jaw having a chuck;

said straightening jaw comprises a straightening insert, wherein said straightening insert comprising a prismatic from having a first end, a saddle-shaped straightening indentation on said first end, and a locking device, independent of said chuck, for preventing relative rotation with respect to said chuck.

* * * * *

UNITED STATES PATENT AND TRADEMARK OFFICE

CERTIFICATE OF CORRECTION

PATENT NO. : 5,327,757

DATED : July 12, 1994

INVENTOR(S) : Stephan Wirth

It is certified that error appears in the above-indentified patent and that said Letters Patent is hereby corrected as shown below:

Column 5, line 24, claim 19, delete "firs tend" and insert --first end--.

Column 6, line 18, claim 20, delete "comprising" and insert --comprises--.

Column 6, line 19, claim 20, delete "from" and insert --form--.

Signed and Sealed this

Eighteenth Day of April, 1995

Bruce Lehman

*Attest:*

BRUCE LEHMAN

*Commissioner of Patents and Trademarks*

*Attesting Officer*